US009884996B2

(12) United States Patent
Samman

(10) Patent No.: US 9,884,996 B2
(45) Date of Patent: Feb. 6, 2018

(54) BULGE-RESISTANT COKE DRUM

(71) Applicant: Houston Engineering Solutions, LLC, Houston, TX (US)

(72) Inventor: Mahmod Samman, Houston, TX (US)

(73) Assignee: HOUSTON ENGINEERING SOLUTIONS, LLC, Houston, TX (US)

( * ) Notice: Subject to any disclaimer, the term of this patent is extended or adjusted under 35 U.S.C. 154(b) by 245 days.

(21) Appl. No.: 14/834,500

(22) Filed: Aug. 25, 2015

(65) Prior Publication Data

US 2017/0058201 A1 Mar. 2, 2017

(51) Int. Cl.

| | |
|---|---|
| ***C10B 29/08*** | (2006.01) |
| ***C10B 1/04*** | (2006.01) |
| ***C10B 25/00*** | (2006.01) |
| ***C10B 23/00*** | (2006.01) |
| *C10B 55/00* | (2006.01) |

(52) U.S. Cl.
CPC ..... *C10B 29/08* (2013.01); *C10B 1/04* (2013.01); *C10B 23/00* (2013.01); *C10B 25/00* (2013.01); *C10B 55/00* (2013.01)

(58) Field of Classification Search
CPC ..... C10B 29/08; C10B 1/04; C10B 23/00; C10B 25/00; C10B 55/00
See application file for complete search history.

(56) References Cited

U.S. PATENT DOCUMENTS 6,193,848 B1 * 2/2001 Shockley ..... B01J 3/04 202/108
2002/0157987 A1 * 10/2002 Schulz ..... B01J 19/0053 208/131

OTHER PUBLICATIONS

ASME. (1998). Section VIII, Div. 1: Boiler and Pressure Vessel Code. The American Society of Mechanical Engineers. New York, NY.*
CB&I—"BP Refinery Coke Drums," Webpage at http://www.cbi.com/project-profiles/bp-refinery-coke-drums, date unknown, 1 page.
Stewart, Coby—"Vertical Plate Technology Extends the Life of Coke Drums" article in Welding Journal, Apr. 2004, pp. 34-36.
Stewart, Coby et al.—"Coke drum design" article in PTQ Q3 2006, 6 pages.
PCT International Search Report and Written Opinion dated Oct. 14, 2016, for International Patent Application No. PCT/US2016/044629.

* cited by examiner

*Primary Examiner* — In Suk Bullock
*Assistant Examiner* — Youngsul Jeong
(74) *Attorney, Agent, or Firm* — Patterson & Sheridan, L.L.P.

(57) ABSTRACT

A coke drum apparatus including: a cylindrical section; a cap connected to an upper end of the cylindrical section; a bottom, and a knuckle connecting the bottom and the cylindrical section. The cylindrical section includes a plurality of arcuate segments attached together by vertical welds. Each arcuate segment includes a plurality of arcuate plates attached together by circumferential welds. The circumferential welds of each arcuate segment are offset from the circumferential welds of each adjacent arcuate segment.

9 Claims, 2 Drawing Sheets

BULGE-RESISTANT COKE DRUM

BACKGROUND OF THE DISCLOSURE

Field of the Disclosure

The present disclosure generally relates to a bulge-resistant coke drum.

Description of the Related Art

Delayed petroleum coking is a process in which a petroleum fraction is heated to a temperature at which it thermally decomposes to provide a solid coke product and a hydrocarbon distillate product. In general, a liquid petroleum feed stock is first distilled until the lighter ends have been recovered and a heavy residuum remains. This heavy residuum of heated pitch and cat-cracked heavy or cycle oil is charged to the bottom of a pressure vessel called a coke drum.

In the coke drum, the heavy residuum is further heated to one thousand degrees Fahrenheit or more and undergoes extensive and controlled cracking and coking under high-pressure conditions. A cracked lighter product rises to the top of the coke drum in a process called steam stripping and is drawn off. A heavier product remains and cracks to coke, a solid, coal-like substance. The coke is usually purged with steam to remove any remaining volatile components. After the cracking and coking process is complete, quench water is introduced and high-pressure water jets are used to cut away and remove the coke. The water reduces the temperature in the drum to around two hundred degrees Fahrenheit or less before a new cycle begins.

In order to increase production speed, the quenching operation is often done as quickly as possible. Unfortunately, the faster the coke is quenched, the greater the wear and tear on the drum. One of the primary causes of this wear and tear is that the steel plate and the weld material joining the rings of plate that form the drum have different yield and creep strengths. In the vicinity of the circumferential weld sites, thermal cycling causes progressively increasing permanent strains, eventually leading to bulging and cracking and often bringing to an end the useful life of the drum.

U.S. Pat. No. 6,193,848 (FNI: Shockley, A'ee: CB&I) discloses a coke drum made by a plurality of vertical plates bent such that widths thereof are curved and adjoined by vertical welds. Unfortunately, due to manufacturing limitations, the length of the plates is limited to forty feet which is less than the typical length of modern coke drums such that the drum is left with at least one circumferential weld. Further, the coke drum requires extensive modification to the manufacturing process for conventional coke drums leading to a significant increase in cost and effort.

There remains a need for a coke drum that can better withstand extreme thermal cycling.

SUMMARY OF THE DISCLOSURE

The present disclosure generally relates to a bulge-resistant coke drum. In one embodiment, a bulge-resistant coke drum includes: a cylindrical section; a cap connected to an upper end of the cylindrical section; a bottom, and a knuckle connecting the bottom and the cylindrical section. The cylindrical section includes a plurality of arcuate segments attached together by vertical welds. Each arcuate segment includes a plurality of arcuate plates attached together by circumferential welds. The circumferential welds of each arcuate segment are offset from the circumferential welds of each adjacent arcuate segment.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
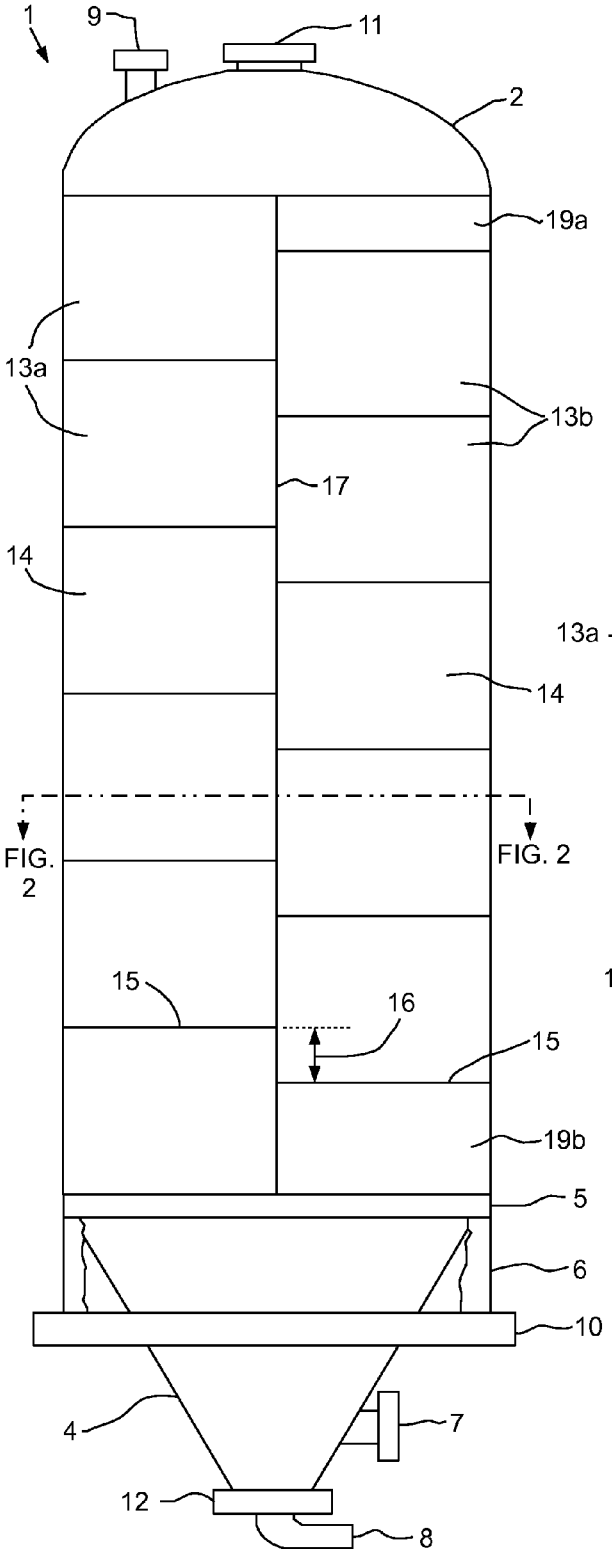
FIGS. 1 and 2 illustrate a bulge-resistant coke drum, according to one embodiment of the present disclosure.
Figure 2:
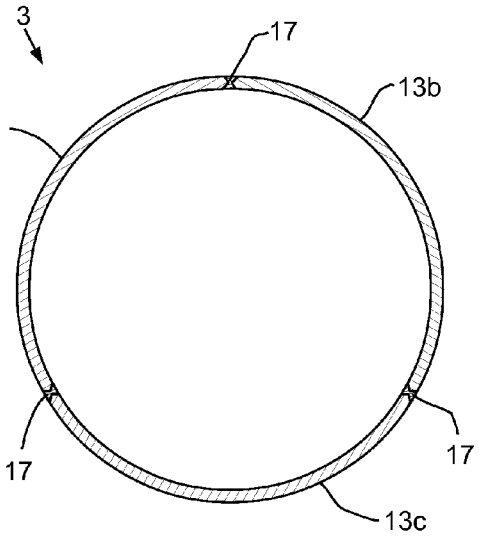
Figure 3:
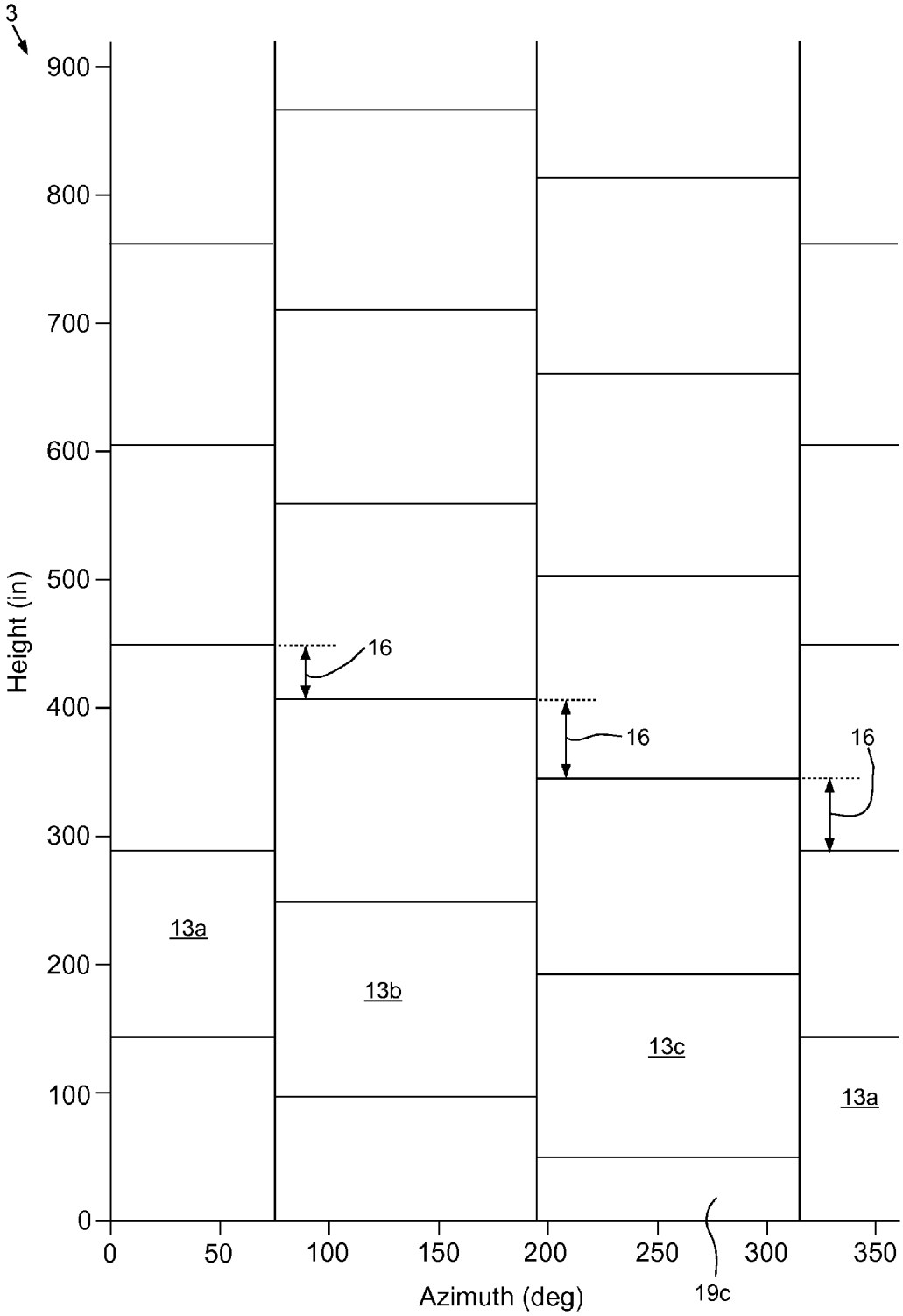
FIG. 3 is a weld map of a portion of a cylindrical section of the coke drum.

FIGS. 1 and 2 illustrate a bulge-resistant coke drum 1, according to one embodiment of the present disclosure. FIG. 3 is a weld map of a portion of a cylindrical section 3 of the coke drum 1. The coke drum 1 may include a cap 2, the cylindrical section 3, a bottom 4, a knuckle 5, a skirt 6, a steam inlet 7, a feed inlet 8, a recovery outlet 9, a restraint structure 10, and a clean-out port 11. A body 2-4 of the drum 1 and the skirt 6 may be made from a metal or alloy, such as steel. The steel may be plain carbon, low alloy, or stainless. The skirt 6 may be made from the same or different metal or alloy than the body 2-4. The coke drum 1 may be vertically oriented. The cap 2 may be welded or fastened to the cylindrical section 3. The knuckle 5 may connect the bottom 4 and the cylindrical section 3, such as by welding or fastening. The cap 2 may be hemispherical, hemi-ellipsoidal, or torispherical. Alternatively, the cap 2 may be a blind flange.

The recovery outlet 9 may be formed through a wall of the cap 2 for withdrawing hydrocarbon vapors from the coke drum 1 during petroleum coking. The clean-out port 11 may also be formed through the wall of the cap 2 for passing an auger or power washing string to remove the solidified coke. The bottom 4 may be conical or a polygonal approximation thereof to allow processed coke to be easily withdrawn from the coke drum 1 through a flanged opening 12 formed at a lower end thereof. The steam inlet 7 may be formed through a wall of the bottom 4 for adding energy to the product to remove any remaining volatile components before the coke is quenched. The feed inlet 8 may be connected to the flanged opening for feeding petroleum distillate and quench water to the coke drum 1.

A diameter of the cylindrical section 3 may be greater than or equal to twelve feet and less than or equal to fifty feet. A length of the cylindrical section 3 may be greater than or equal to thirty, forty, fifty, sixty, or seventy feet. The skirt 6 may be connected to the body 2-4 at the knuckle 5, such as by welding. A thickness of the cylindrical section 3 may be constant.

The cylindrical section 3 may be constructed from a plurality, such as two, three, or four arcuate segments 13*a-c*. Each arcuate segment 13*a-c* may have a central angle equal to three hundred and sixty degrees divided by the number thereof. Each arcuate segment 13*a-c* may be made from a plurality of arcuate plates 14. Each arcuate plate 14 may be rolled into the arcuate shape such that a length thereof is curved. Before rolling, each plate 14 may be rectangular having a width greater than or equal to five feet and less than or equal to sixteen feet and a length substantially greater than the width. The length of each plate 14 may be greater than the width thereof by a ratio greater than or equal to one and one half, such as two. A thickness of each plate 14 may be greater than or equal to one-half inch and less than or equal to three inches so that the coke drum 1 may be capable of sustaining an internal pressure of greater than or equal to fifty psig and less than or equal to one hundred and fifty psig.

A number, such as three to ten, of the arcuate plates 14 may then be stacked horizontally and attached together by circumferential welds 15, thereby forming one 13*a* of the arcuate segments 13*a*-13*c*. Once the first arcuate segment 13*a* has been formed, each adjacent arcuate segment 13*b,c* may be formed in a similar fashion except that the circumferential welds 15 thereof may be offset 16 from the circumferential welds of the first arcuate segment 13*a* such that the cylindrical section 3 has no continuous circumferential weld. The offset 16 may be a fraction of the width of each arcuate plate 14 and may be greater than or equal to one-half foot, one foot, two feet, or three feet. The offset 16 may be formed by cutting off a portion of each end plate 19*a-c* of each adjacent arcuate segment 13*b,c* along the longitudinal axis thereof, thereby reducing widths of the cut end plates. Once all of the arcuate segments 13*a-c* have been formed, the arcuate segments may be attached together by vertical welds 17, thereby forming the cylindrical section 3. Each vertical weld 17 may extend along an entire length of the cylindrical section 3.

Advantageously, the discontinuity in the circumferential welds 15 due to the offset 16 disrupts the constraint on thermal expansion of the coke drum 1 which would otherwise happen with continuous circumferential welds.

The restraint structure 10 may secure the skirt 6 to a structural frame or foundation, such as a pedestal, footing, or slab, while accommodating thermal cycling of the body 2-4. The restraint structure 10 may secure the body 2-4 against toppling and/or twisting, such as due to wind loading and/or thermal cycling of connected piping.

Alternatively, instead of having a constant thickness, the thickness of the cylindrical section 3 may be at a maximum at a lower end thereof and taper to a minimum at an upper end thereof.

While the foregoing is directed to embodiments of the present disclosure, other and further embodiments of the disclosure may be devised without departing from the basic scope thereof, and the scope of the invention is determined by the claims that follow.

The invention claimed is:

1. A bulge-resistant coke drum, comprising:
- a cylindrical section;
- a cap connected to an upper end of the cylindrical section;
- a bottom, and
- a knuckle connecting the bottom and the cylindrical section, wherein:
- the cylindrical section comprises a plurality of arcuate segments attached together by vertical welds,
- where each arcuate segment is rectangular in shape, and
- each arcuate segment comprises a plurality of arcuate plates attached together by circumferential welds, and
- the circumferential welds of each arcuate segment are offset from the circumferential welds of each adjacent arcuate segment to produce an offset between each arcuate segment
- wherein the offset is greater than or equal to 6 inches.

2. The bulge-resistant coke drum of claim 1, wherein the cylindrical section has no continuous circumferential weld due to the offset.

3. The bulge-resistant coke drum of claim 2, wherein a length of the cylindrical section is greater than or equal to 50 feet.

4. The bulge-resistant coke drum of claim 1, wherein:
- each arcuate plate is rolled such that a length thereof is curved, and
- the arcuate plates of each arcuate segment are stacked vertically.

5. The bulge-resistant coke drum of claim 1, wherein each vertical weld spans the entire length of the cylindrical section.

6. The bulge-resistant coke drum of claim 1, wherein the cylindrical section is made from a material selected from a group consisting of plain carbon steel, low alloy steel, and stainless steel.

7. The bulge-resistant coke drum of claim 1, wherein each arcuate segment comprises 3-10 arcuate plates.

8. The bulge-resistant coke drum of claim 1, wherein the bottom is conical or polygonal-conical.

9. The bulge-resistant coke drum of claim 1, further comprising:
- a recovery outlet formed through a wall of the cap;
- a clean-out port formed through the wall of the cap;
- a steam inlet formed through a wall of the bottom; and
- a feed inlet connected to a flanged opening formed through the wall of the bottom.

* * * * *